US005184953A

United States Patent [19]

McDermott

[11] Patent Number: 5,184,953

[45] Date of Patent: Feb. 9, 1993

[54] WATER COOLING PIPE CORRECTION TO VERTICALLY UNSYMMETRICAL HEATING OF BLOOMS IN WALKING-BEAM REHEAT FURNACE

[75] Inventor: John F. McDermott, Monroeville Boro, Pa.

[73] Assignee: USX Corporation, Pittsburgh, Pa.

[21] Appl. No.: 787,987

[22] Filed: Nov. 5, 1991

[51] Int. Cl.[5] ..... F27B 9/14

[52] U.S. Cl. ..... 432/123; 432/127; 432/234; 432/10; 432/81

[58] Field of Search ..... 432/148, 126, 127, 128, 432/133, 234, 122, 123, 10, 81

[56] References Cited

U.S. PATENT DOCUMENTS 4,368,695 1/1983 Davies ..... 432/234

4,560,346 12/1985 Schulz ..... 432/148

*Primary Examiner*—Henry C. Yuen

*Attorney, Agent, or Firm*—W. F. Riesmeyer, III

[57] ABSTRACT

Apparatus is provided for decreasing temperature differentials within rectangular metal blooms being heated in a furnace. The apparatus includes elongated internally cooled members located above the blooms adjacent an exit end of the furnace. The longitudinal axes of the internally cooled members are parallel to each other and to the longitudinal axes of the blooms, the latter axes being aligned so as to extend transversely with respect to the direction of movement of the blooms from an entry to an exit end of the furnace.

8 Claims, 2 Drawing Sheets

WATER COOLING PIPE CORRECTION TO VERTICALLY UNSYMMETRICAL HEATING OF BLOOMS IN WALKING-BEAM REHEAT FURNACE

BACKGROUND OF THE INVENTION

This invention relates to heating furnaces for metal blooms or billets in which the blooms or billets are aligned transversely to their direction of movement through the furnace, and particularly to such a furnace having an internally cooled member located above the blooms or billets and extending parallel to them adjacent the exit end of the furnace.

In the production of seamless steel pipe, blooms are typically reheated prior to the piercing operation in a furnace of the walking beam type. In these furnaces, 10½ inch square blooms, for example, separated by air gaps of 8 to 9 inches are conveyed through the various heating zones by a walking beam mechanism which periodically lifts each bloom, advances and then deposits it back on water cooled skid pipe rails. The furnace usually has three heating zones, e.g., preheat, heating and soak zones. Each zone has top and bottom burners for applying heat to the adjacent surfaces of the blooms. To remove cold spots on the bottom of the blooms due to contact with the skid rails, the bottom burners in the heating and/or soak zones may be fired harder than the top burners. However, due to the gap or spacing between the blooms, additional heat radiates to the furnace roof and is reflected back to the top surface of the blooms. Thus, temperature differentials in the vertical direction commonly occur to varying degrees in the blooms. Additionally, horizontal temperature gradients are caused due to the "cold door effect" at the exit end of the furnace. Cold air enters the furnace through the discharge door and causes horizontal temperature variation in the blooms. Also, the fact that the heating zone is generally hotter than the soak zone, causes the same effect of horizontal temperature variation. A possible solution would be to rotate the blooms in the furnace by a turning mechanism. Such a device would necessarily be of complex mechanical design, as well as difficult and uneconomical to operate.

U.S. Pat. No. 2,776,128, Nesbitt, et al., describes a forge furnace having water-cooled skid rails which support elongated metal workpieces as they pass longitudinally through a fast heating section of the furnace. Toward the discharge end of the furnace, the workpieces are passed onto an underfired open-work refractory hearth designed to remove cold spots on the bottom surfaces of the workpieces from the skid rails. At this location, the water-cooled skid rails are extended upwardly above the workpieces to form "shadow" rail sections in a shielding position out of contact with the workpieces between their upper surfaces and the hot furnace wall. By the shielding of the shadow rail sections, the top surfaces of the workpieces which reach the desired discharge temperature faster than the cooler bottom surfaces are prevented from overheating. In this reference, the shadow rails extend parallel to the direction of workpiece flow rather than transversely as in applicant's invention. Applicant's invention permits the effect of an internally cooled member to be concentrated near the furnace exit where it is needed most for minimizing vertical temperature gradients or at some other distance from the exit to minimize horizontal temperature gradients. It also permits correction of temperature differentials in both a vertical and horizontal direction in the workpieces.

U.S. Pat. No. 2,940,741, Nesbitt, discloses a forge furnace for the fast heating of billets. The furnace comprises a refractory lined tunnel forming a cylindrical chamber. The reference states that in a furnace having a circular combustion chamber which is tangentially fired, it is possible to maintain combustion against the refractory wall of the furnace as a relatively thin sleeve in the chamber. It also states that it is possible to maintain unusually high wall temperatures for rapid "high heat head" heating. The temperatures maintained in the heating chamber, generally in excess of 2600° F., are so high as to practically preclude the use of other than refractory or water-cooled work supports in the furnace chamber. The method of firing demands that the water-cooled supports be kept out of the sleeve or path of burning gases in the furnace chamber; otherwise, they would chill the gases before combustion was complete. The reference further states that where the workpieces are required to be pushed through the furnace broadside first, the ends of the workpieces tend to become overheated. This is due to a radiation phenomenon where the furnace wall temperature is considerably in excess of the final desired work temperature. To prevent this overheating, a pair of internally cooled side rails are provided and form a channel between which the work pieces are moved. Where the shadow rails are not used, non-uniform heating of the ends overheats the steel, making a sticky scale which rapidly deteriorates forging dies. The scale is worked into the surface of the workpiece in the dies and is very detrimental to the dies, causing materially shortened die life and subsequent machining troubles. This reference does not address and shows no recognition of the problem of decreasing temperature differentials in a vertical direction in workpieces being transported through a furnace.

Other references of interest are U.S. Pat. Nos. 234,162; 782,697; 1,535,132; 1,841,692; 2,689,119; 2,735,229; and 3,342,468.

SUMMARY OF THE INVENTION

According to this invention, a furnace is provided for heating rectangular metal blooms. The furnace includes a refractory-lined chamber having an opening at an entry end for receipt of a plurality of blooms therein and an opening at an opposed exit end for discharge of the blooms therethrough. Means is provided for support of the blooms during movement of them from the entry to the exit end of the chamber. The blooms are aligned so that their longitudinal axes extend transversely with respect to the direction of their movement through the chamber. When the blooms are transported in this manner, horizontal as well as vertical temperature differentials occur because the vertical faces constitute a substantial portion (i.e., about 50 percent) of the bloom total surface. At least one internally cooled elongated member is provided above and spaced from the upper surfaces of the blooms adjacent to the exit end of the furnace. The internally cooled elongated member extends longitudinally parallel to the longitudinal axes of the blooms so as to substantially decrease any temperature differential within the blooms. Of particular advantage is the fact that since the internally cooled member extends parallel to the longitudinal axes of the blooms, there is no need to maintain equal spacing between a plurality of such members, and the distances of the members from the exit can, on the bases of calculations or in-service experience, be optimized to minimize horizontal temperature gradients in the blooms. When the members extend transversely with respect to the main axes of the blooms and longitudinally parallel to the direction of bloom travel through the furnace, the spacing must be the same, otherwise temperature variations would be caused in the blooms along their length.

The invention is particularly applicable to walking beam type reheat furnaces for heating blooms separated by a substantial air gap therebetween and is effective in decreasing temperature differentials in both vertical and horizontal directions in the blooms in such furnaces. In a preferred form apparatus is provided for insertion through an opening in the furnace chamber. A particular advantage is that an optimum location of the apparatus for minimizing horizontal temperature differentials as well as those in a vertical direction can be found without making a permanent installation.

DESCRIPTION OF THE PREFERRED EMBODIMENT

Figure 1:
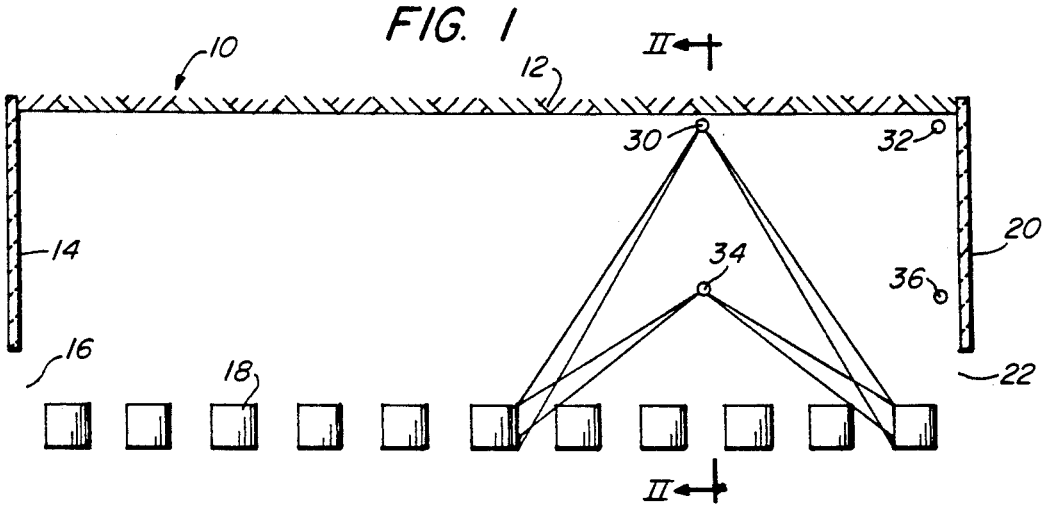
FIG. 1 is a schematic side elevation view of a furnace having apparatus according to this invention therein.
Figure 2:
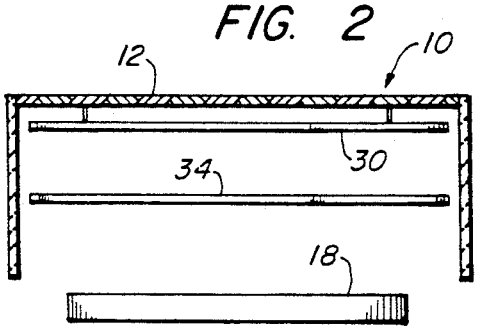
FIG. 2 is a section taken at II—II of FIG. 1.

Referring to FIG. 1, a furnace 10 is schematically shown which has a refractory lined chamber with a roof 12, a wall 14 and an entry opening 16 therein for receipt of rectangular metal blooms 18. The furnace also has a wall 20 with an opening 22 at an exit end of the furnace for discharge of the blooms therethrough. A walking beam mechanism (not shown) of well known type is intermittently actuable to lift each metal bloom and transport it a predetermined distance along a path from the entry to the exit end of the furnace. According to this invention, apparatus is provided adjacent the exit end of the furnace in the form of internally cooled elongated members or pipes schematically illustrated at 30 and 32 above the top surface of metal blooms 18. By "adjacent", I mean anywhere from the middle of the soak zone to the furnace exit. One or more of the internally cooled elongated members may be provided close to the furnace roof or at any location above the top surface of the blooms as at positions 34 and 36. The purpose of the internally cooled member is to provide a certain portion of the radiant surfaces in view by the blooms that is at a temperature significantly less than that of the furnace ceiling and walls. FIG. 2 shows that the longitudinal axes of the internally cooled elongated members 30 and 32 are parallel to the longitudinal axes of metal blooms 18. Both the blooms and the internally cooled members are aligned transversely to the direction of movement 38 of the blooms through the furnace in FIG. 1.

Figure 4:
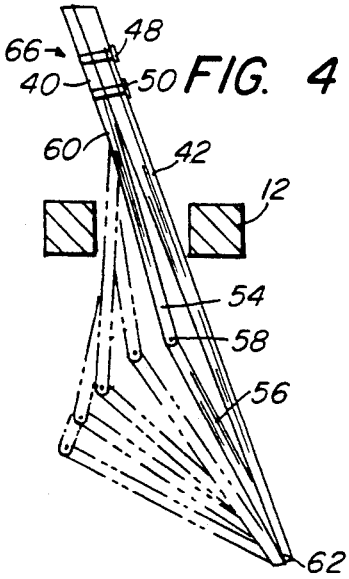
FIG. 4 is a side elevation view similar to FIG. 3 showing the apparatus in one position for insertion through an opening in the roof of the furnace and movement to another position for operation during reheat of blooms in the furnace.
Figure 3:
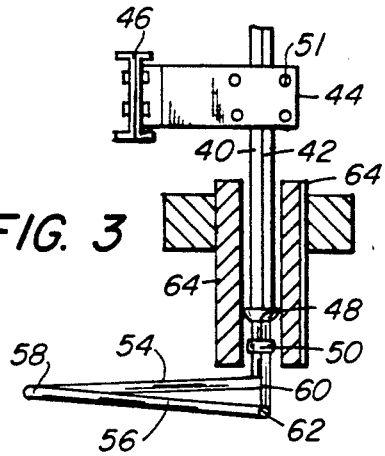
FIG. 3 is a side elevation view of the apparatus according to this invention.

Referring to FIG. 3, the apparatus of this invention includes an entry pipe section 40 and exit pipe section 42 shown mounted in support means 44 attached to beam 46. A pair of guide means 48 and 50 are provided for guiding longitudinal slidable movement of the entry and exit pipe sections with respect to each other before support means 44 is clamped by bolts 50 to secure them in operating position. A pair of scissors pipe sections 54 and 56 are connected to each other at one end by an articulating joint 58. The opposite end of scissors section 54 is connected to end of entry pipe section 40. Similarly, the opposed end of scissors section 56 is connected to exit pipe section 42. These connections are made by articulating joints 60 and 62, respectively. In FIG. 4, the apparatus is shown being inserted through an opening in the roof 12 of the refractory lined furnace chamber. After insertion, by slidably moving entry pipe section 40 longitudinally with respect to exit pipe section 42 in the direction 66 the scissors pipe sections 54 and 56 are caused to rotate about the axes of articulating joints 58, 60 and 62 in a vertical plane. This permits movement of the scissors pipe sections to a substantially horizontal operating position as shown in FIG. 3. After movement of the scissors sections to the operating position refractory shroud material 64 is provided for closing off the opening in the furnace roof.

Figure 5:
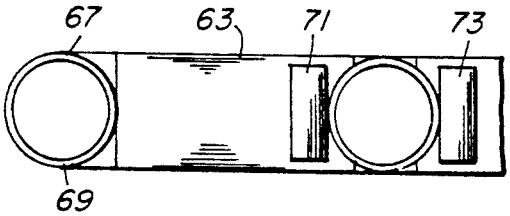
FIG. 5 is an enlarged schematic plan view of a guide for permitting slidable longitudinal movement of entry and exit sections of the apparatus of FIG. 3.

Referring to FIG. 5, guide means 48 and 50 each includes a frame 63 attached, for example, by welding to one of the pipe sections as at 67 and 69. Rollers 71 and 73 are rotatably mounted on frame 63 to guide movement of the pipe sections.

Figure 7:
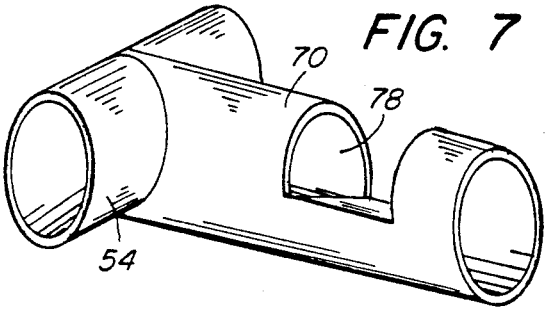
FIG. 7 is an enlarged isometric view of a first part of one of the articulating joints of the apparatus shown in FIG. 6.
Figure 8:
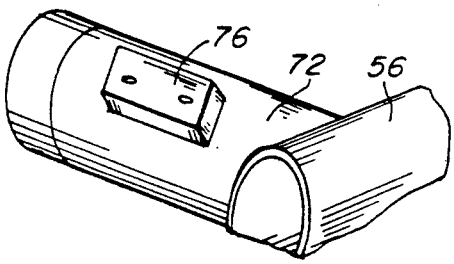
FIG. 8 is an enlarged isometric view of a second part of an articulating joint which is mateable with and is adapted to be inserted into the first part shown in FIG. 7.
Figure 6:
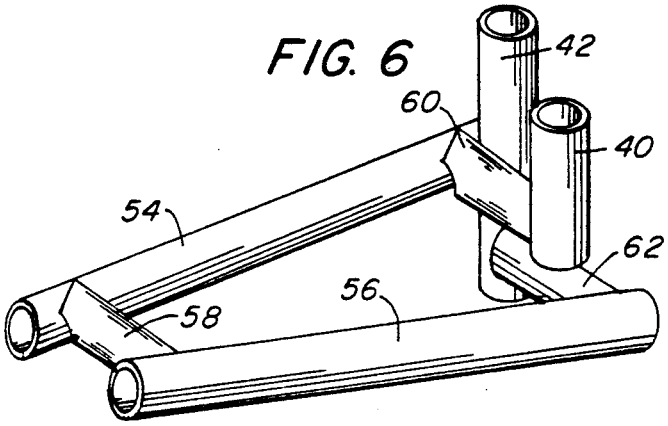
FIG. 6 is an enlarged isometric view of entry and exit sections of the apparatus of FIG. 3, together with scissors sections and the articulating joints therebetween.

Referring to FIG. 6, an enlarged view is shown of the scissors pipe sections 54 and 56 as connected by articulating joints 58, 60 and 62 to entry and exit pipe sections 40 and 42. The latter in turn are connected to water or other cooling fluid inlets and outlets (not shown). Referring to FIGS. 7 and 8, articulating joint 58 includes a first pipe 70 (FIG. 7) attached in fluid communication to scissors section 54. A second pipe 72 (FIG. 8) is attached in fluid communication to scissors section 56. An elastomeric O-ring seal 74 is provided so as to form a fluid tight seal between the first pipe 70 and second pipe 72 when the latter is inserted into the former in concentric relationship. A stop means 76 is provided on second pipe 72 and moveable within opening 78 of the first pipe so as to limit rotatable movement of the first and second pipes in articulating fashion. Articulating joints 60 and 62 are of the same construction.

Figure 10:
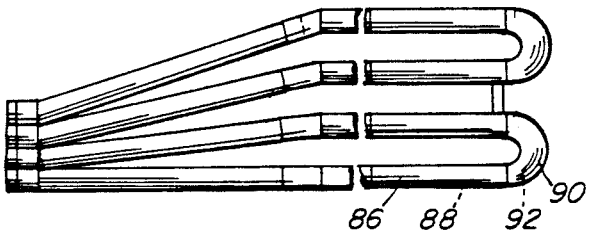
FIG. 10 is a partial plan view of the apparatus of FIG. 9.
Figure 9:
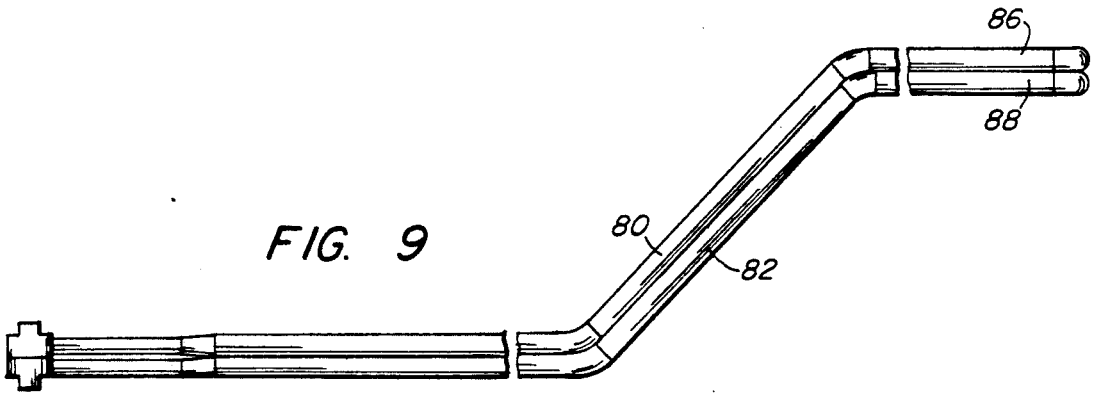
FIG. 9 is a side elevation view of an alternate embodiment of the apparatus of this invention.

In an alternative embodiment, shown in FIGS. 9 and 10, a plurality of pipes 80 and 82 are anchored at 84 outside the refractory lined furnace chamber. The pipes 80 and 82 extend upwardly to horizontal extensions 86 and 88 which are adapted to be inserted through an opening in a vertical side wall of the furnace chamber. The horizontal extensions each form a loop 90 and 92 for circulation of cooling fluid received from an inlet back to an outlet end of each pipe. The horizontal extensions are adapted to be located above the blooms adjacent to the exit end of the furnace so that their longitudinal axes are parallel to the longitudinal axes of the blooms.

Other alternative embodiments are also contemplated as being within the scope of the present invention. For example, internally cooled pipe members may be permanently mounted in a furnace chamber and attached to the furnace roof or walls by other internally cooled pipe loops extending beneath the first mentioned pipe members forming a cradle to which the first mentioned pipe members are attached.

I claim:

1. A furnace for heating rectangular blooms, comprising:

a refractory lined chamber having an opening at an entry end thereof for receipt of a plurality of rectangular blooms and an exit opening at an opposed end thereof for discharge of said blooms therefrom, means for supporting said blooms during movement thereof from the entry to the exit end of said chamber, said blooms being aligned so that their longitudinal axes extend transversely to the direction of their movement through the chamber, at least one internally cooled elongated member located above and spaced from the upper surfaces of the blooms adjacent to the exit opening of the chamber, said internally cooled elongated member extending longitudinally in a direction parallel to the longitudinal axes of the blooms so as to substantially decrease any temperature differential within said blooms.

2. The furnace of claim 1 wherein said internally cooled elongated member is mounted on a cantilever support structure external to the furnace chamber, said internally cooled elongated member extending longitudinally through a side opening into the furnace chamber above the top surfaces of the blooms without support within the furnace chamber.

3. The furnace of claim 1 wherein said internally cooled elongated member comprises a pair of elongated inlet and outlet sections aligned in parallel relationship adapted to extend downwardly through an opening in an upper surface of the furnace chamber, said inlet and outlet sections being slidably movable longitudinally with respect to each other, a pair of elongated scissors sections connected end to end to each other and to the inlet and outlet sections, said scissors sections being movable in a vertical plane by slidably moving the inlet and outlet sections with respect to each other, said scissors sections being movable back and forth from a position with their longitudinal axes axially aligned generally parallel to the axes of the inlet and outlet sections for insertion into the chamber and withdrawal therefrom to a position with their longitudinal axes substantially transverse to the axes of the inlet and outlet sections, said scissors sections extending in the latter position within the chamber and substantially parallel to the upper surfaces of the blooms.

4. A walking beam type furnace for heating rectangular metal blooms wherein said blooms are transported with their longitudinal axes transverse to the direction of transport and the blooms are separated by a substantial gap therebetween, said furnace comprising:

a refractory lined chamber having an opening at an entry end thereof for receipt of a plurality of said blooms and an exit opening at an opposed end thereof for discharge of said blooms therefrom, means for supporting said blooms during movement thereof from the entry to the exit end of said chamber, said blooms being aligned so that their longitudinal axes extend transversely to the direction of their movement through the chamber, at least one internally cooled elongated member located above and spaced from the upper surfaces of the blooms adjacent to the exit opening of the chamber, said internally cooled elongated member extending longitudinally in a direction parallel to the longitudinal axes of the blooms so as to substantially decrease any temperature differential within said blooms.

5. The walking beam type furnace of claim 4 wherein said internally cooled elongated member is mounted on a cantilever support structure external to the furnace chamber, said internally cooled elongated member extending longitudinally through a side opening into the furnace chamber above the top surfaces of the blooms without support within the furnace chamber.

6. The walking beam type furnace of claim 4 wherein said internally cooled elongated member comprises a pair of elongated inlet and outlet sections aligned in parallel adjacent relationship adapted to extend downwardly through an opening in an upper surface of the furnace chamber, said inlet and outlet sections being slidably movable longitudinally with respect to each other, a pair of elongated scissors sections connected end to end to each other and to the inlet and outlet sections, said scissors sections being movable in a vertical plane by slidably moving the inlet and outlet sections with respect to each other, said scissors sections being movable back and forth from a position with their longitudinal axes axially aligned generally parallel to the axes of the inlet and outlet sections for insertion into the chamber and withdrawal therefrom to a position with their longitudinal axes substantially transverse to the axes of the inlet and outlet sections, said scissors sections extending in the latter position within the chamber and substantially parallel to the upper surfaces of the blooms.

7. An apparatus for insertion through an opening in a furnace for decreasing temperature differentials in rectangular metal blooms to be heated in said furnace, said apparatus comprising:

a pair of elongated inlet and outlet sections aligned in parallel adjacent relationship adapted to extend downwardly through an opening in an upper surface of the furnace chamber, said inlet and outlet sections being slidably movable longitudinally with respect to each other, a pair of elongated scissors sections connected end to end each other and to the inlet and outlet sections, said scissors sections being movable in a vertical plane by slidably moving the inlet and outlet sections with respect to each other, said scissors sections being movable back and forth from a position with their longitudinal axes axially aligned generally parallel to the axes of the inlet and outlet sections for insertion into the chamber and withdrawal therefrom to a position with their longitudinal axes substantially transverse to the axes of the inlet and outlet sections, said scissors sections extending in the latter position within the chamber and substantially parallel to the upper surfaces of the blooms.

8. The apparatus of claim 7 further comprising a plurality of articulating joints connecting each scissors section to each other and to the entry and exit sections, each of said articulating joints including a first pipe, a second pipe adapted for insertion into the first pipe, and means for fluid tight sealing engagement between the first and second pipes.

* * * * *